US007959148B2

(12) United States Patent
Alsip et al.

(10) Patent No.: US 7,959,148 B2
(45) Date of Patent: Jun. 14, 2011

(54) MEDIA FRICTION BUCKLER ASSEMBLY

(75) Inventors: Michael Lee Alsip, Lexington, KY (US); Daniel Robert Gagnon, Harrodsburg, KY (US); Kris Eren Kallenberger, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/544,820

(22) Filed: Aug. 20, 2009

(65) Prior Publication Data

US 2011/0042885 A1 Feb. 24, 2011

(51) Int. Cl.
*B65H 3/52* (2006.01)

(52) U.S. Cl. ..... 271/121; 271/167

(58) Field of Classification Search ..... 271/121, 271/126, 16, 19, 21, 167
See application file for complete search history.

(56) References Cited

U.S. PATENT DOCUMENTS

| | | | | |
|---|---|---|---|---|
| 5,895,040 | A | 4/1999 | Oleksa et al. | |
| 5,971,390 | A * | 10/1999 | Caspar et al. | 271/121 |
| 6,536,757 | B2 | 3/2003 | Chang | |
| 7,066,461 | B2 | 6/2006 | Asada | |
| 7,108,257 | B2 | 9/2006 | Shiohara et al. | |
| 7,172,192 | B2 * | 2/2007 | Mitsuhashi | 271/121 |
| 7,434,800 | B2 | 10/2008 | Asada et al. | |
| 7,770,885 | B2 | 8/2010 | Klein | |
| 2003/0137094 | A1 * | 7/2003 | Hsieh | 271/121 |
| 2003/0184004 | A1 * | 10/2003 | Shiohara et al. | 271/121 |
| 2004/0017039 | A1 * | 1/2004 | Asada et al. | 271/121 |
| 2006/0180993 | A1 * | 8/2006 | Lee | 271/121 |
| 2008/0211169 | A1 * | 9/2008 | Klein | 271/167 |

FOREIGN PATENT DOCUMENTS

EP 19140 A * 11/1980

OTHER PUBLICATIONS

Prosecution history of related application U.S. Appl. No. 11/681,230 (now issued as US Patent No. 7,770,885) including Non-Final Office Action dated Oct. 9, 2009 and response filed Jan. 6, 2010, Notice of Allowance dated Apr. 6, 2010 and Issue Notification dated Jul. 21, 2010.

* cited by examiner

*Primary Examiner* — Jeremy Severson
(74) *Attorney, Agent, or Firm* — John Victor Pezdek

(57) ABSTRACT

A tuned media buckler comprises a body made of a plastic material, a rib extending from the upper surface of the body with an overall flat configuration and uniform rigidity with the rib running along the upper surface and centrally lengthwise along the body, a spring force material backing the lower surface of the body opposite to the rib that compresses against the lower surface of the body in response to the generally normal force applied to the top edge surface of the rib by a media stack, and a housing having a central aperture running lengthwise of the housing such that the rib of the media buckler extends through the aperture for engagement by a media stack.

21 Claims, 5 Drawing Sheets

MEDIA FRICTION BUCKLER ASSEMBLY

CROSS REFERENCES TO RELATED APPLICATIONS

The present application is related to co-pending application Ser. No. 11/681,230, filed Mar. 7, 2007, entitled "Variable Stiffness Friction Buckler," the contents of which are incorporated by reference in their entirety

BACKGROUND

1. Field of the Invention

The present invention relates generally to media feed mechanisms and, more particularly, to a friction buckler assembly for the media feed mechanism to prevent multi-sheet feeding of recording media wherein two or more sheets are fed during a single sheet feeding operation.

2. Description of the Related Art

In a conventional single sheet printer, sheets from a media stack are indexed from the stack into the printer feedpath so as to begin a printing cycle. This operation is commonly known as sheet picking and is performed by advancing the uppermost sheet from the media stack using a motor driven roller in an arrangement sometimes referred to as a media feed mechanism which may include a rotational indexing or auto-compensating mechanism. The roller of the auto-compensating mechanism rotates against the surface of the uppermost media sheet to direct the sheet into the media feedpath for printing or other processing involving auto-document feeding.

A friction buckler assembly well known in the prior art is comprised of a friction buckler made out of a piece of ridged pellethane used to separate sheets of media as they are fed into the feed nip of an L-path printer. It is backed by a piece of foam that, along with the "legs" of the buckler, applies a spring force normal to the feed path in the opposite direction of the force applied by the media as it is fed. The amount of protrusion of the ridged rib through the buckler housing is commonly referred to as the buckler height. In order for a friction buckler to function properly, the ridged top surface of the friction buckler ridged rib must come in contact with the leading media edge and cause a buckling motion on the front of the media stack as it is put into motion by the pick tire. When the media buckles, the buckler is said to be "defeated" and the media will have a small mark on it where it has conformed to the profile of the friction buckler. Once this mark is present, the page will slide over the rest of the ridges on the top of the friction buckler surface and into the feed nip, where the rest of the printing process will occur. When media is picked by the pick tire, the media is driven down onto the friction buckler with some force (usually around 1.3 kgf) and the friction buckler assembly provides an opposite force that is slightly less than the force exerted by the media. Deflection of the ridged buckler surface occurs slightly and allows for the media to slide slightly forward until it meets a ridge and is buckled by the applied force of the pick tire. Once this buckling occurs, the media then slides over the rest of the ridges with ease and is fed into the feed nip. The crucial force to be tuned here is the backing force of the buckler assembly. This force has important implications to the feed process. As an example, a low force will allow for multiple sheets to be fed into the feed nip because of too much deflection of the pellethane buckler. Conversely, a force that is too high can cause feed problems for heavier weight medias that have higher beam strength and are more difficult to buckle.

As feed quality has become a more apparent issue due to demands for quality improvements, the ability to tune the friction buckler and the force used to buckle each sheet has grown more important. Due to the inconsistencies in the molding process of pellethane, the prior art friction buckler assembly design has varying spring forces because of the inherent physical property variations in the friction buckler, itself. Thus, a solution to tuning the spring force is to eliminate the impact of the inconsistencies of the pellethane in the system.

SUMMARY OF THE INVENTION

The present invention meets this need by providing a friction buckler that is easier to tune due to the reduction of the number of spring forces behind the buckler and the reduction of noise within the processing of the pellethane. The complex spring system behind the buckler is eliminated therefore allowing for easier tuning of the force behind the friction buckler that is used to buckle the media during the pick process. Further, eliminating the legs of the buckler allows for potentially looser molding conditions of the pellethane because the molding tolerances have a lesser impact on the forces generated by the buckler and also on the buckler height itself.

Accordingly, in an aspect of the present invention, a media buckler assembly comprises a media dam with a housing connected to the media dam. The housing has an aperture with a friction buckler disposed between the housing and the media dam. The friction buckler comprises a body made of a plastic material with upper and lower surfaces of substantially the same lengths and widths and spaced apart from and interconnected to one another by a peripheral edge surface of a predetermined height so as to provide said body with an overall flat configuration of uniform rigidity; and a rib extending from the upper surface of the body through a substantially uniform predetermined height and running generally centrally lengthwise along the body. The rib has media sheet gripping elements defined on a top edge surface of the rib. The body has an overall flat configuration and uniform rigidity. The rib runs along the upper surface and centrally lengthwise along the body to provide the friction buckler with a substantially uniform rigidity that resists lengthwise and widthwise leaf spring deflection thereof in response to a generally normal force applied to the top edge surface of the rib by a media stack.

In another aspect of the present invention, a tuned media buckler comprises a body made of a plastic material, with the body having upper and lower surfaces of substantially the same lengths and widths and spaced apart from and interconnected to one another by a peripheral edge surface so as to provide the body with an overall flat configuration of uniform rigidity. A rib extends from the upper surface of the body through a substantially uniform height and running generally centrally lengthwise along the body with the rib having media sheet gripping elements defined on a top edge surface of the rib. The body of the overall flat configuration and uniform rigidity and the rib running along the upper surface and centrally lengthwise along the body provide the media buckler with a substantially uniform rigidity that resists lengthwise and widthwise leaf spring deflection thereof in response to a generally normal force applied to the top edge surface of the rib by a media stack. A spring force material backs the lower surface of the body of the media bucker substantially opposite to the rib. The spring force material has a substantially uniform thickness so as to substantially function as a spring of a preselected rate that uniformly compresses against the lower surface of the body in response to the generally normal force applied to the top edge surface of the rib by a media stack.

In another aspect of the present invention, the tuned media buckler assembly further comprises a housing having a central aperture running lengthwise of the housing such that the rib of the media buckler extends through the aperture for engagement by a media stack.

BRIEF DESCRIPTION OF THE DRAWINGS

Figure 1:
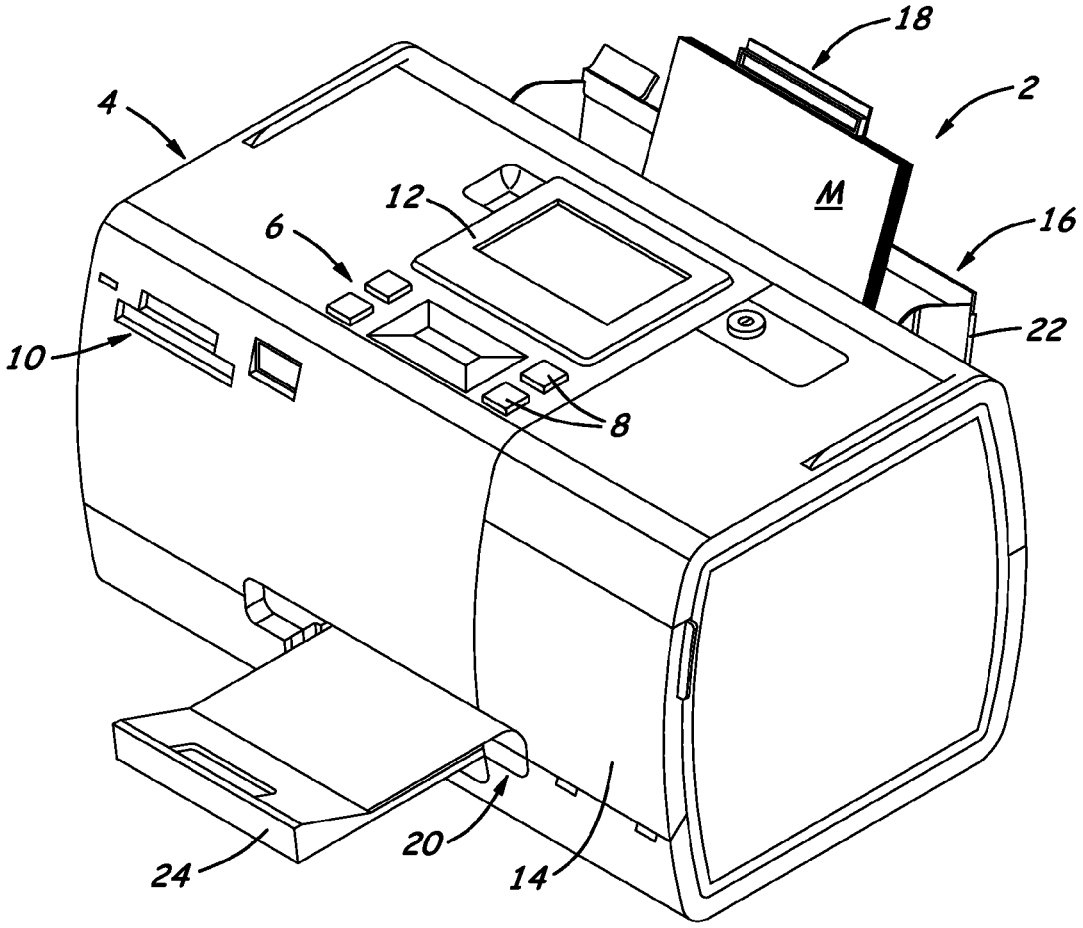

Having thus described the invention in general terms, reference will now be made to the accompanying drawings, which are not necessarily drawn to scale, and wherein:

FIG. 1 is a perspective view of an exemplary print peripheral utilizing a media feeding mechanism.

Figure 2:
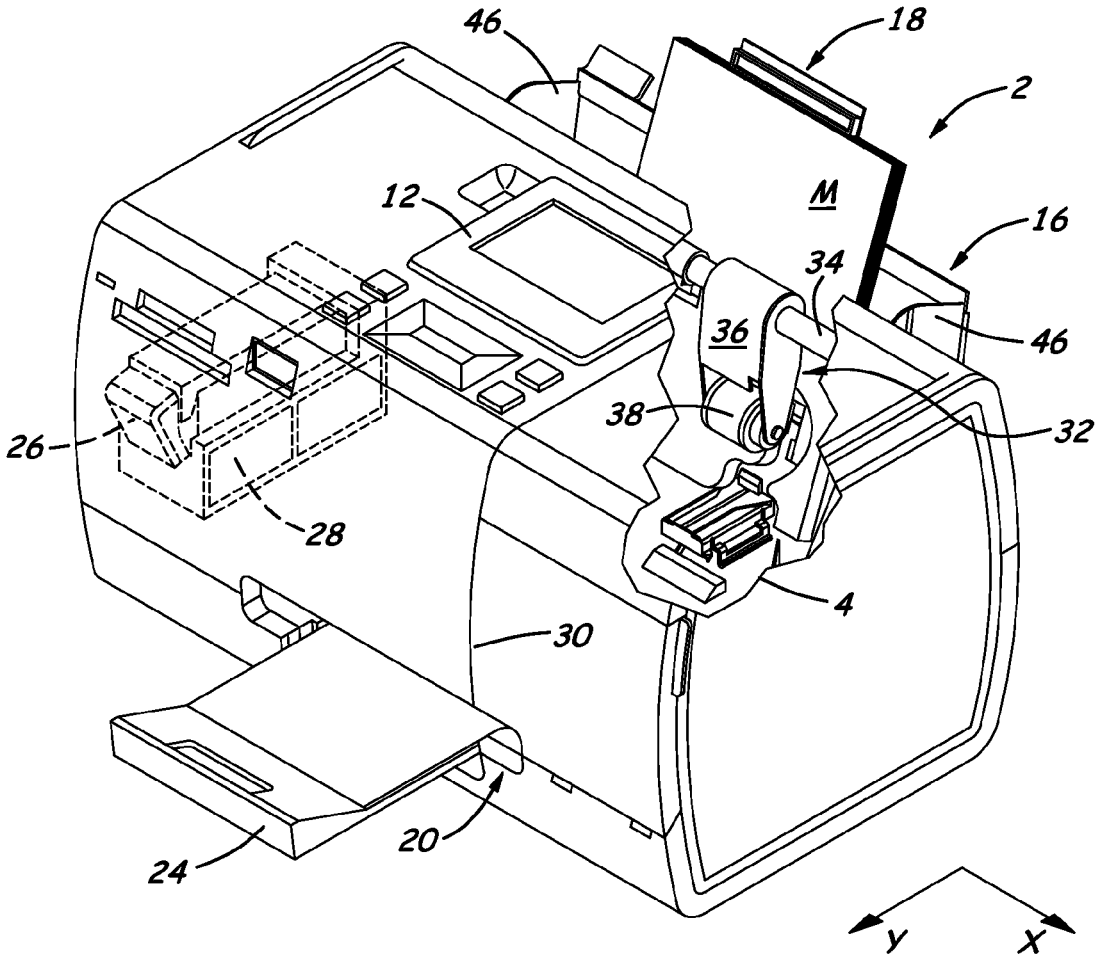

FIG. 2 is a cut-away perspective view of the interior of the peripheral device.

Figure 3:
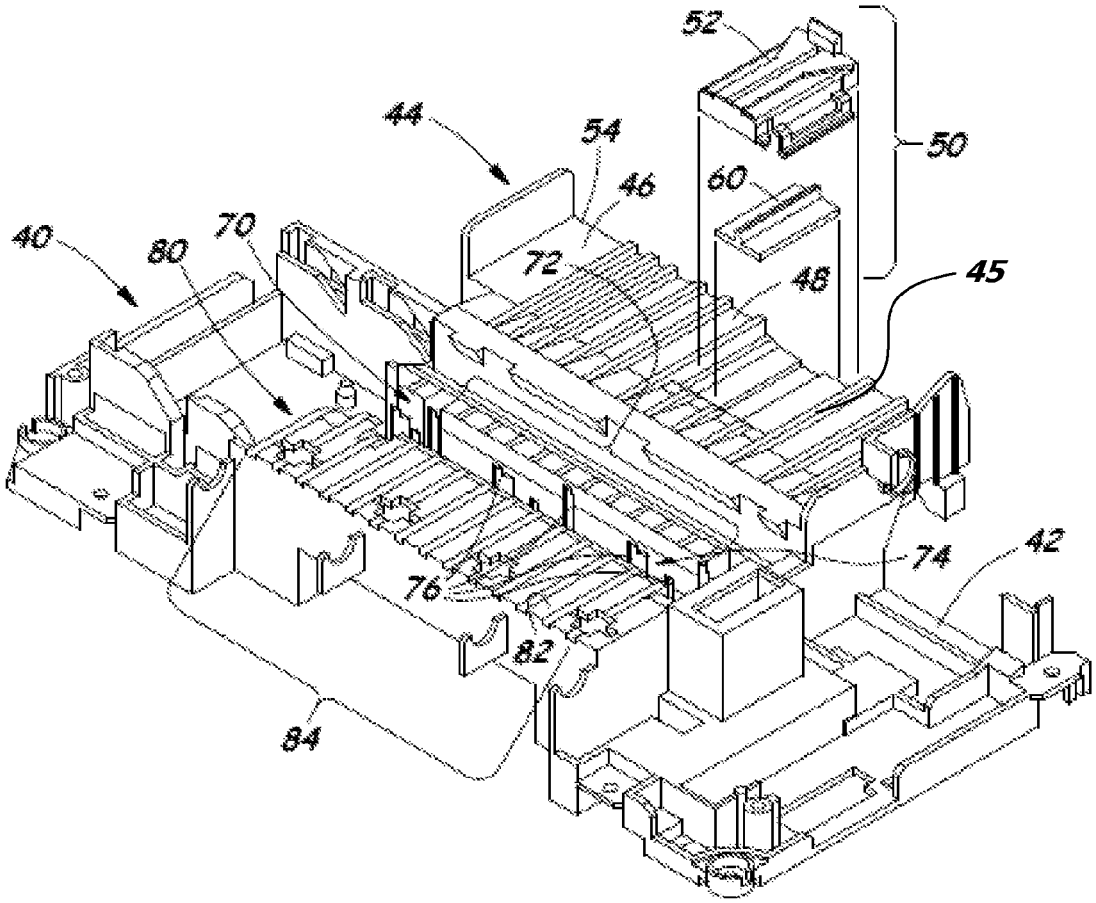

FIG. 3 is a partially exploded perspective view of printer midframe including a tuned media buckler.

Figure 4:
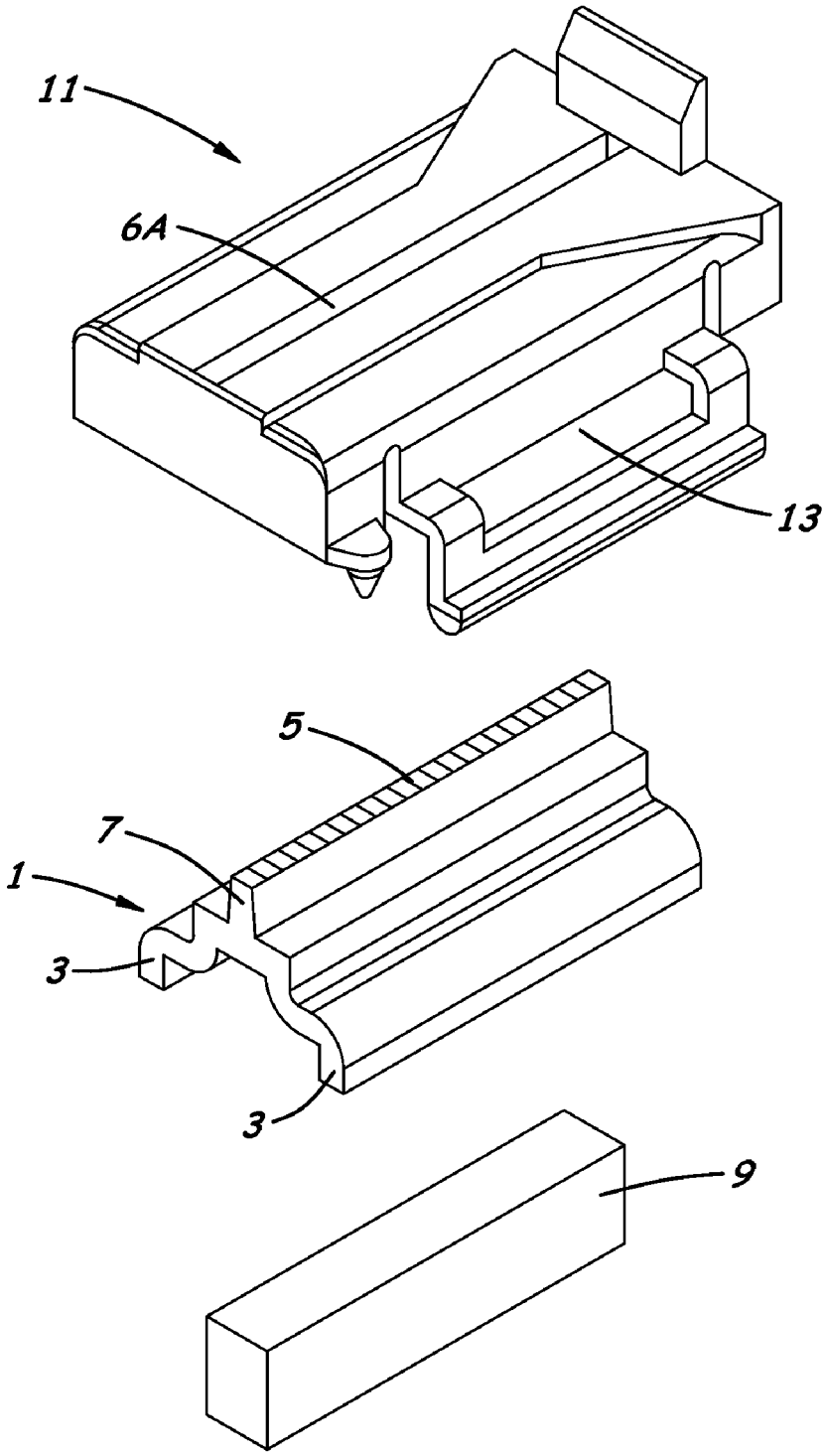
Fig. 4 (PRIOR ART)

FIG. 4 is a cut-away perspective view of a prior art friction buckler assembly.

Figure 5:
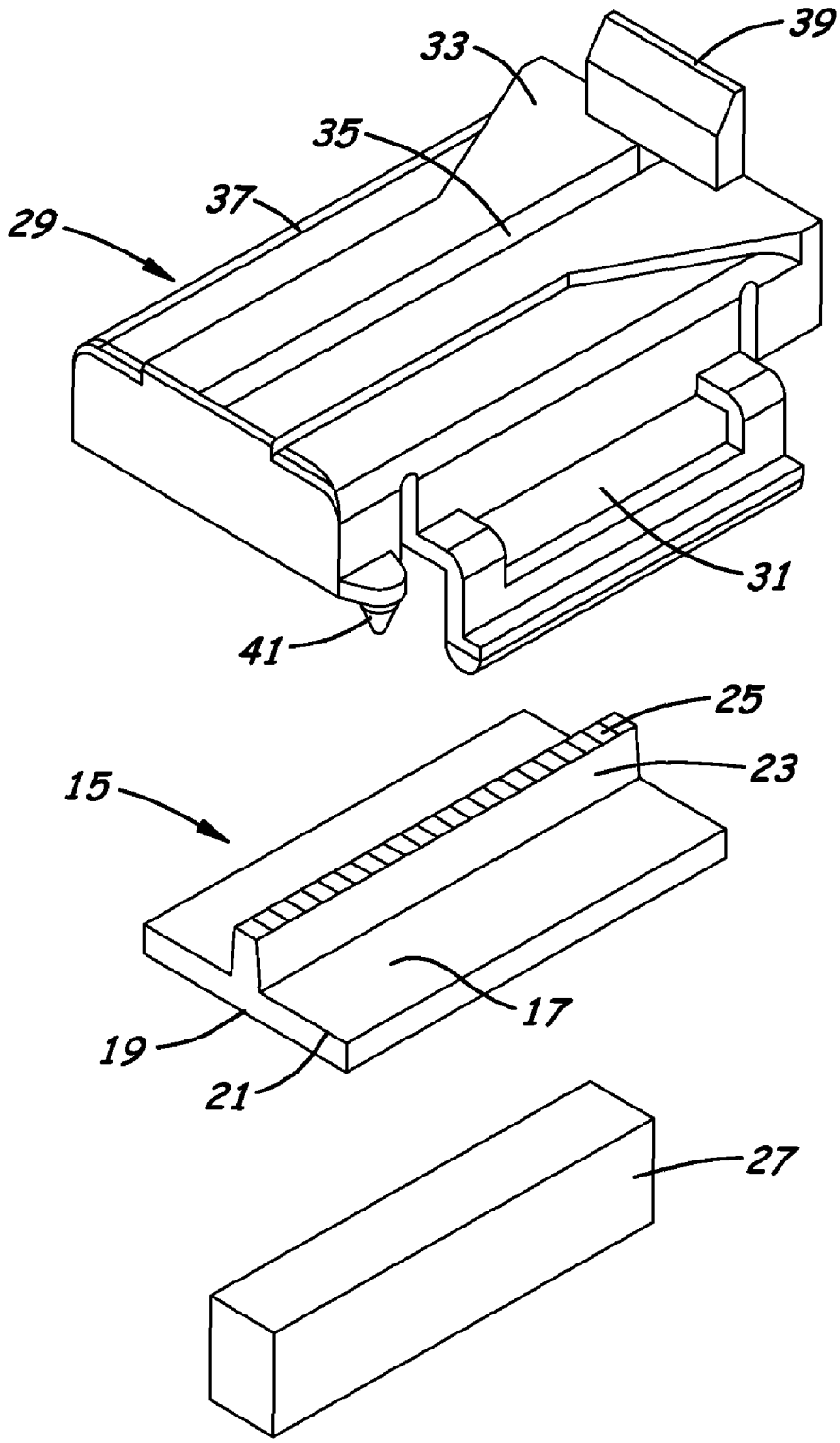

FIG. 5 is a cut-away perspective view of the friction buckler assembly of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring initially to FIG. 1, a printing peripheral or device 2 is shown having a housing 4. The exemplary printer 2 is shown and described herein as a photo printer, however one of ordinary skill in the art will understand upon reading of the instant specification that the friction buckler may be utilized with a stand alone printer, copier, auto-document feeding scanner, all-in-one, multi-function peripheral or other peripheral utilizing a sheet feeder. The peripheral device 2 further comprises a control panel 6 on the housing 4 having a plurality of buttons 8 for making selections. The control panel 4 may include a graphics display 12 to provide a user with menus, choices or errors occurring with the system. The exemplary graphics display 12 may also be utilized to view images, which will be printed, and edit the images prior to printing. The exemplary graphics display 12 may be a liquid crystal display (LCD) having an exemplary resolution of about 480×240 pixels but it is within the scope o the present invention that an alternative display type or resolution be utilized. The graphics display 12 may be rotatable from the horizontal position depicted to an upright position for easier viewing during use. The housing 4 may also comprise at least one aperture 10 for receiving memory devices (not shown).

Still referring to FIG. 1, extending from the housing 4 is a media input 16 at the rear of the device 2 and a media output 20 at the front of the device 2 for retaining media M before and after a print process, respectively. Hereinafter, the indicator M is used for both individual sheets (medium) and a plurality of sheets (media). The media input 16 is defined by a tray and may include an extendable media support 18 to support media M while such media M is located in a generally upright position. The media output 20 comprises an aperture in housing 4 along a front surface of the device 2. The media output 20 may also include a tray 24 which is extendable into and out of the output 20 to support media M exiting the peripheral 2. Adjacent the media output 20 is a door 14 providing access to the interior of the peripheral 2 for changing ink cartridges. Along the top surface of housing 4 is a handle 22 to aid in carrying the peripheral 2 although such structure should not be construed as limiting. The handle 22 is pivotably connected to the peripheral 2, however alternative handle constructions may be utilized such as slidably extendable handles or the like.

Referring now to FIG. 2, an interior cut-away perspective view of the printer device 2 is depicted. A media feedpath 30 extends between the input 16 and the output 20. The media feedpath 30 is substantially L-shaped in the exemplary embodiment, but one skilled in the art will ascertain that the present invention may alternatively be used with a C-shaped or straight-through media feedpath. Also shown inside the peripheral 2 is a carriage 28 and at least one ink cartridge 26, each depicted in broken lines. The at least one print cartridge 26 which may be, for instance, a color cartridge including three inks for color images i.e., cyan, magenta and yellow. Alternatively, multiple cartridges may be utilized including, for example, a color cartridge and a black ink cartridge for text printing or for photo printing or, in another arrangement, two color cartridges may be used where the second cartridge contains dilute cyan, magenta, and yellow inks. During feeding, media M moves from the media input 16 to the media output 20 along the media feedpath 30 beneath the carriage 28 and cartridge 26. As the media moves in a first Y-direction into a printing zone, the carriage 28 and the cartridges 26 move bi-directionally along the second, X-direction through the printing zone and transverse to the movement of the media M. During each scan of the carriage 28 and the at least one cartridge 26, the print medium is held stationary. A driving signal from a print controller to a motor (not shown) causes reciprocating or scanning movement of carriage 28 based on received image data at the printer controller (not shown). A typical ink jet printer forms an image on a print medium by ejecting ink from the plurality of ink jetting nozzles to form a pattern in ink dots on the print medium. The print head of the cartridge 26 may include a plurality of nozzle arrays, arranged in a column of nozzle arrays. The cartridge 26 is supplied with electric energy to generate a bubble ejecting ink to the adjacent media M.

Shown in the housing cut-way, a media feed mechanism 32 is depicted adjacent the media input 16. Beneath the housing 4 is an auto-compensating mechanism shaft 34. The shaft 34 is rotatably mounted and driven by a gear transmission (not shown) within the peripheral 2. The shaft 34 drives an auto-compensating mechanism (ACM) or rotatably indexing mechanism 36, which picks the uppermost media sheet M within the tray 16 and indexes the media M into the media feedpath 30. The term uppermost should be understood to mean the medium closest to the ACM 36. The indexing mechanism 36 incrementally advances the print medium in a feed (Y) direction. The ACM 36 has a plurality of gears (not shown) and at least one roller 38 which engages each medium M for indexing. The rotatable indexing mechanism 36 is used broadly herein to mean any belt of gear driven sheet pick/feed mechanism or other suitable sheet media advancing means such as the aforementioned ACM 36. Since ACM 36 are known to one skilled in the art, such structure will not be described further.

Behind the rotatably indexing mechanism 36, the media M is inserted at the media input 16 and against the extendable tray 18 and a planar surface defining a portion of media input tray 16. Extending from the side edges of the input 16 to the housing 4 are media input sidewalls 46 which generally define the maximum media width that can be used in the edge-to-edge printing device 2. Adjacent the at least one sidewall 46 may be at least one automatic edge aligning device slidably positioned for adjustment from an innermost position for narrow media to an outer position for receiving wider media within the input area 16. Further, such edge aligning device may be biased, for instance spring biased, toward the opposite sidewall 46 so that the edges of the media M are aligned on one side by the sidewall 46 and the slidable edge aligning device on the opposite side.

Referring to FIG. 3, a mid-frame 40 is depicted. The mid-frame 40 comprises a lower base surface 42 from which a plurality of molded parts extend. The media input 22 is positioned along a rear portion of the mid-frame base 42 extending upwardly at an angle therefrom so that a media dam 44 defines a lower portion of the media input 16. The media dam 44 includes a plurality of dam ribs 45 extending in a horizontal direction parallel to the Y-direction or feedpath direction 30, previously described. The media M is generally supported by the ribs 45 when inserted into the media input 16. The ribs 45 extend from a body 54 defining a lower surface of the media dam 44 from which the dam ribs 45 extend upwardly. The dam ribs 45 also extend horizontally, as previously defined, in a direction of the media feedpath 30 from the rear of the media input 22 toward a print zone 70.

The media dam 44 further comprises a buckler assembly 50 which is defined by a housing 52, the body 54 and a friction buckler 60, which will be described further herein. When inserted in the media input 22, the media M also engages the buckler assembly 50. Although a single buckler assembly 50 is depicted, multiple assemblies may be utilized. Moving downstream from the media dam 44 along the direction of the media feedpath 30 is the print zone 70 above which the at least on ink cartridge 26 (FIG. 2) is reciprocally moved bi-directionally along the X-axis by the carriage 28 (FIG. 2). As the media M moves into the print zone 70 in the feedpath direction 30, the cartridge 26 and carriage 28 move transversely to the media M and selectively eject ink onto the media M.

As the media M indexes from the media dam 44 towards the print zone 70, the leading edge of the medium M engages a plurality of print zone entry ribs 72. The entry ribs 72 support the leading edge of each media M as it enters the print zone 70 and portions of the media M upstream of the print zone 70 as indexing continues. Downstream of the entry ribs 72 is an ink trough 74 which collects overspray during edge-to-edge printing. Within the ink trough 74 are a plurality of support ribs 76 which support the media M as the media M passes over the ink trough 74. Once the leading edge of the media M passes the ink trough 74, the media M engages an exit frame 80 having a base 82, a plurality of exit ribs 84, as well as exit rollers (not shown) which are housed within the exit frame 80 and aligned with the exit ribs 84. The media M, containing the printed image, passes from the exit rollers (not shown) and exits the peripheral 2 through the media output 20.

Referring now to FIG. 4, there is illustrated a prior art friction buckler assembly in perspective view. The friction buckler, shown generally as 1, is a piece of pellethane plastic with ridged rib 7 that is backed by a piece of foam 9 that, along with the legs 3 of the friction bucker 1 applies a spring force normal to the feed path in the opposite direction of the force applied by the media as it is fed. The ridged top surface 5 of the ridged rib 7 comes in contact with the leading media edge and causes a buckling motion on the front page of a stack of media as it is put into motion by a pick tire. When the media buckles, the friction buckler 1 is defeated and the media will have a small mark on it where it has conformed to the profile of the friction buckler 1. Once this mark is present the page slides over the rest of the ridged top surface 5 of the friction buckler surface and into a feed nip (not shown), where the rest of the printing process will occur. A buckler housing shown generally as 11 has a central aperture 6A running lengthwise of the buckler housing 11 such that ridged rib 7 of the friction buckler 1 extends through the aperture 6A for engagement by a media stack. It should be noted that when the molding conditions of the pellethane in the friction buckler 1 produces inconsistencies in molecular weight, the spring force produced by the legs 3 is negatively impacted. Further, the prior art buckler height is dependent on four variables: buckler ridged rib 7 height, foam 9 height, buckler preload, and buckler housing 11 thickness.

Referring now to FIG. 5, there is illustrated a tuned media buckler assembly of the present invention. A friction buckler is shown generally as 15 is a body made of a plastic material with upper surface 17 and lower surface 19 are of substantially the same lengths and widths and spaced apart from and interconnected to one another by a peripheral edge surface 21 of a height less than the length or width of the upper and lower surfaces so as to provide the body with an overall flat configuration of uniform rigidity. The plastic material is a formulation selected from a plurality of alternate pellethane formulations. Further, the upper and lower surfaces of said body are substantially parallel to one another and the peripheral edge surface of the body is substantially perpendicular to the upper and lower surfaces.

Still referring to FIG.5, a ridged rib 23 extends from the upper surface 17 of the body through a height less than the length or width of the upper surface 17 and lower surface 19 of the body and running generally centrally lengthwise along the body. The ridged rib 23 has media sheet gripping elements defined on a top edge surface of the ridged rib 23. The body of the overall flat configuration and uniform rigidity and the ridged rib 23 running along the upper surface 17 and centrally lengthwise along the body provide the friction buckler 15 with a substantially uniform rigidity that resists lengthwise and widthwise leaf spring deflection thereof in response to a generally normal force applied to the top edge surface 25 of the ridged rib 23 by a media stack (not shown).

Still referring to FIG. 5, a spring force material 27 backs the lower surface 19 of the body of the friction bucker 15 substantially opposite the ridged rib 23. The spring force material 27 substantially functions as a spring of a preselected rate that compresses against the lower surface 19 of the body in response to the generally normal force applied to top edge surface 25 of the ridged rib 23 by a media stack. The spring force material 27 can be made from foam, a spring, a series of springs, molded plastic features, gel or other suitable plastic material. The ridged top surface 25 of the ridged rib 23 comes in contact with the leading media edge and causes a buckling motion on the front page of a stack of media as it is put into motion by a pick tire (not shown). When the media buckles, the friction buckler 15 is defeated and the media will have a small mark on it where it has conformed to the profile of the friction buckler 15. Once this mark is present the media slides over the rest of the ridged top surface 25 of the friction buckler surface and into a feed nip (not shown), where the rest of the printing process will occur. As the friction buckler 25 does not have any legs to apply a secondary spring force as shown in FIG. 4 prior art, the impact of any molding conditions that produce inconsistencies in pellethane molecular weights is eliminated by the present invention. Additionally, alternate pellethane formulations may be used to reduce wear on the friction buckler 15 which can cause reduced rigidity profile and cause double feeding and other general pick problems. As the combined spring force of the prior art friction buckler with legs is no longer an issue because of the present invention's legless design, different materials may be used to counteract any wear issues. For example, using a harder formulation could reduce wear.

Still referring to FIG. 5, a buckler housing shown generally as 29 has a central aperture 35 running lengthwise of the buckler housing 29 such that ridged rib 23 of the friction buckler 15 extends through the aperture 35 for engagement by a media stack. The housing 29 comprises a hollow body portion 33 having at least one retaining arm 31 extending from the body 33. The depicted housing 29 comprises opposed retaining arms extending from longitudinal sides of the body 33. The housing 29 is generally rectangular in shape having parallel longer longitudinal dimensions and parallel shorter latitudinal dimensions. The body 33 also has a media lip 39 extending from an upper surface thereof. The media lip 39 has a rounded or tapered upper edge so as to direct media downward to the upper surface of the body 33. Aperture 35 extends longitudinally along the central portion of the body 33. The aperture 35 has a length and width which generally match that of the ridged rib 23 of the friction buckler 15. Since the body 33 is generally hollow, the housing 29 is positioned over the friction buckler 15 and the ridge rib 23 extends through the aperture 35. The ridged rib 23 may extend above the uppermost surface of the hollow body so that as the media is positioned in the media input, the media engages the upper surface 25 of the ridged rib 23. The housing 29 may also comprise one or more aligning pins 41 for proper alignment of the housing 29 relative to the body 54 of the media dam. One advantage to the present invention is that the buckler height tuning is no longer dependent upon the buckler preload or the foam height, provided that the foam is at least thick enough so that the buckler housing 29 and the friction buckler 15 are in firm contact with each other. The stack-up of dimensions determining buckler height in the prior art is across four different parts, whereas the present invention determines buckler height solely by the friction buckler 15 and the buckler housing 29 which allows for a much more controllable system with respect to buckler height.

The legless friction buckler 15 as shown in FIG. 5 results in a reduction of material volume. By reducing the material volume, the cost of manufacturing the friction buckler 15 is reduced. Further, differential forces may be applied against the friction buckler 15 by increasing or decreasing the spring force material 27 interference. The compression of the spring force material 27 against the bottom surface of the friction buckler 15 determines the force applied against the media during the pick process outlined earlier. By using only the spring force material 27 as the spring, there is the opportunity to differentiate forces across the friction buckler 15. For example, as a stack of media continually has media sheets picked from it, the entire stack begins to move toward the front of the friction buckler 15, which can be detrimental to a single sheet pick (i.e. cause double feeds and multi-feeds); however, with differential forces, the height of the spring force material 27 near the back of the friction buckler 15 can be varied so that compression of the friction buckler 15 is much more difficult and will not allow the entire stack to compress the buckler and shift forward.

The buckler height and spring force may be adjusted independently. Thus, the system could be tuned first for buckler height and then for buckler force without having one influence the other. The spring force could be varied over the length of the friction buckler. Further, the spring force can be directly calculated as the force generated by the compression of the spring force material. Finally, friction bucklers of other materials and designs could benefit from the design of the present invention. For instance a cork, cork impregnated rubber, or other material friction buckler formed using molded, extruded or rolled process could benefit from this design in similar ways. For example, the spring force could be varied over the length of the friction buckler, the force could be directly calculated, and the buckler height can be directly measured in an unassembled state.

One of ordinary skill in the art will understand upon reading of the instant specification that the tuned media buckler may be utilized with a stand alone printer, copier, auto-document feeding scanner, all-in-one, multi-function peripheral or other peripheral utilizing a sheet feeder.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A media buckler assembly, comprising:

a media dam;

a housing connected to said media dam;

said housing having an aperture;

a friction buckler disposed between said housing and said media dam, said friction buckler comprising;

a body made of a plastic material, said body having upper and lower surfaces of substantially the same lengths and widths and spaced apart from and interconnected to one another by a peripheral edge surface of a predetermined height so as to provide said body with an overall flat configuration of substantially uniform rigidity; and a rib extending from said upper surface of said body through a substantially uniform predetermined height, running generally centrally lengthwise along said body and extending through said aperture in said housing, said rib having media sheet gripping elements defined on a top edge surface of said rib, said rib having a width that is substantially less than said widths of said upper and lower surfaces of said body;

said body of said overall flat configuration and uniform rigidity and said rib running along said upper surface and centrally lengthwise along said body providing said media buckler with a substantially uniform rigidity that resists lengthwise and widthwise leaf spring deflection thereof in response to a generally normal force applied to said top edge surface of said rib by a media stack.

2. The media buckler assembly of claim 1 wherein said plastic material is a formulation pellethane.

3. The media buckler assembly of claim 1 wherein said upper and lower surfaces of said body are substantially parallel to one another.

4. The media buckler assembly of claim 1 wherein said peripheral edge surface of said body is substantially perpendicular to said upper and lower surfaces.

5. The media buckler assembly of claim 1 wherein said housing is clasped to said media dam.

6. The media buckler assembly of claim 5 wherein said rib extends above an upper surface of said housing and flexes upon engagement by media.

7. A tuned media buckler, comprising:

a body made of a plastic material, said body having upper and lower surfaces of substantially the same lengths and widths and spaced apart from and interconnected to one another by a peripheral edge surface of a predetermined height so as to provide said body with an overall flat configuration of uniform rigidity; and a rib extending from said upper surface of said body through a substantially uniform predetermined height and running generally centrally lengthwise along said body, said rib having media sheet gripping elements defined on a top edge surface of said rib, said rib having a width that is substantially less than said widths of said upper and lower surfaces of said body;

said body of said overall flat configuration and uniform rigidity and said rib running along said upper surface and centrally lengthwise along said body providing said media buckler with a substantially uniform rigidity that resists lengthwise and widthwise leaf spring deflection thereof in response to a generally normal force applied to said top edge surface of said rib by a media stack; and a spring force material backing said lower surface of said body of said media buckler substantially opposite said rib, said spring force material having a thickness so as to substantially function as a spring of a preselected rate that compresses against said lower surface of said body in response to the generally normal force applied to said top edge surface of said rib by a media stack.

8. The tuned media buckler of claim 7 wherein said plastic material is a formulation of pellethane.

9. The tuned media buckler of claim 7 wherein said upper and lower surfaces of said body are substantially parallel to one another.

10. The tuned media buckler of claim 7 wherein said peripheral edge surface of said body is substantially perpendicular to said upper and lower surfaces.

11. The tuned media buckler of claim 7 wherein said spring force material is selected from the group consisting of a spring, a series of springs, molded plastic, and gel.

12. The tuned media buckler of claim 7 wherein said spring force material is a block of foam.

13. The tuned media buckler assembly of claim 12 wherein said block of foam is of a substantially uniform thickness.

14. The tuned media buckler assembly of claim 12 wherein said block of foam is of a variable thickness.

15. The tuned media buckler assembly of claim 14 wherein said block of foam of variable thickness applies differential forces across said lower surface of said plastic body of overall flat configuration to determine said preselected rate that compresses against said lower surface of said body in response to the generally normal force applied to said top edge surface of said rib by a media stack.

16. The tuned media buckler of claim 7 further comprising a media buckler assembly.

17. The tuned media buckler of claim 16 wherein said media buckler assembly further comprises a housing having an aperture, said rib extending through said aperture.

18. The tuned media buckler of claim 17 wherein said peripheral edge surface height is determined based on said media buckler assembly height and said rib height.

19. The tuned media buckler of claim 18 wherein said determined peripheral edge surface height is adjusted independent of said preselected rate that compresses against said lower surface of said body in response to the generally normal force applied to said top edge surface of said rib by a media stack.

20. A tuned media buckler, comprising:

a body made of a plastic material, said body having upper and lower surfaces of substantially the same lengths and widths and spaced apart from and interconnected to one another by a peripheral edge surface of a predetermined height so as to provide said body with an overall flat configuration of uniform rigidity; and a rib extending from said upper surface of said body through a substantially uniform predetermined height and running generally centrally lengthwise along said body, said rib having media sheet gripping elements defined on a top edge surface of said rib;

said body of said overall flat configuration and uniform rigidity and said rib running along said upper surface and centrally lengthwise along said body providing said media buckler with a substantially uniform rigidity that resists lengthwise and widthwise leaf spring deflection thereof in response to a generally normal force applied to said top edge surface of said rib by a media stack; and a block of foam backing said lower surface of said body of said media buckler substantially opposite said rib, said block of foam having a variable thickness that substantially functions as a spring of a preselected rate that compresses against said lower surface of said body in response to the generally normal force applied to said top edge surface of said rib by a media stack.

21. The tuned media buckler of claim 20 wherein said block of foam of variable thickness applies differential forces across said lower surface of said plastic body of overall flat configuration to determine said preselected rate that compresses against said lower surface of said body in response to the generally normal force applied to said top edge surface of said rib by a media stack.

* * * * *